US006564527B1

(12) United States Patent
Focke et al.

(10) Patent No.: US 6,564,527 B1
(45) Date of Patent: May 20, 2003

(54) PROCESS AND APPARATUS FOR CHECKING CIGARETTE PACKS FOR THE CORRECT POSITIONING OF MATERIAL STRIPS

(75) Inventors: Heinz Focke, Verden (DE); Ralf Sinnerbrink, Kirchlinteln (DE)

(73) Assignee: Focke & Co. (GmbH), Verden (DE)

( * ) Notice: Subject to any disclaimer, the term of this patent is extended or adjusted under 35 U.S.C. 154(b) by 0 days.

(21) Appl. No.: 09/496,737

(22) Filed: Feb. 2, 2000

(30) Foreign Application Priority Data

Feb. 4, 1999 (DE) ..... 199 04 671

(51) Int. Cl.[7] ..... B65B 57/00

(52) U.S. Cl. ..... 53/53; 53/136.1; 53/234; 53/415; 53/508; 53/575

(58) Field of Search ..... 53/53, 136.1, 136.3, 53/136.4, 234, 415, 508, 575, 579; 156/64, 350, 351, 378; 356/394, 398

(56) References Cited

U.S. PATENT DOCUMENTS

| | | | | | |
|---|---|---|---|---|---|
| 3,522,129 | A | | 7/1970 | Crathern | 156/364 |
| RE30,964 | E | * | 6/1982 | Butner et al. | 209/536 |
| 4,581,730 | A | * | 4/1986 | Ozeki et al. | 370/2 |
| 4,643,027 | A | * | 2/1987 | Deutsch et al. | 53/53 |
| 4,738,073 | A | * | 4/1988 | Mattei et al. | 53/51 |
| 4,906,099 | A | * | 3/1990 | Casasent | 356/394 |
| 4,928,008 | A | * | 5/1990 | Huggins et al. | 250/231.1 |
| 4,972,494 | A | * | 11/1990 | White et al. | 382/8 |
| 5,061,063 | A | * | 10/1991 | Casasent | 250/556 |
| 5,329,359 | A | * | 7/1994 | Tachikawa | 356/398 |
| 5,353,356 | A | * | 10/1994 | Waugh et al. | 382/8 |
| 6,020,969 | A | * | 2/2000 | Struckhoff et al. | 131/907 |
| 6,386,454 | B2 | * | 5/2002 | Hecht et al. | 235/462.16 |

FOREIGN PATENT DOCUMENTS

| | | | |
|---|---|---|---|
| DE | 3808744 | 9/1989 | G11B/23/113 |
| DE | 40 16 150 | 11/1991 | |
| DE | 4112263 | 10/1992 | G01M/11/08 |
| DE | 4441245 | 5/1996 | B65C/9/40 |
| EP | 299 316 | 1/1989 | |
| EP | 314 521 | 5/1989 | |
| EP | 523 441 | 1/1998 | |

* cited by examiner

*Primary Examiner*—Rinaldi I. Rada
*Assistant Examiner*—Hemant M Desai
(74) *Attorney, Agent, or Firm*—Abelman, Frayne & Schwab

(57) ABSTRACT

Process and apparatus for checking (cigarette) packs for the correct positioning of material strips.

In order to check the correct position of a material strip (11) on a cigarette pack (10), at least two sensors are used to compare spaced-apart measurement or checking points (19, 20) in terms of the relative position in relation to one another. This gives the relative position of the material strip (11). If the latter is in a skewed position, the relevant cigarette pack (10) is separated out.

9 Claims, 7 Drawing Sheets

PROCESS AND APPARATUS FOR CHECKING CIGARETTE PACKS FOR THE CORRECT POSITIONING OF MATERIAL STRIPS

FIELD OF THE INVENTION

The invention relates to a process for checking articles, such as packs, for the correct positioning of attached blanks, labels or the like, in particular for checking the correct arrangement of (revenue-stamp) strips on cigarette packs. The invention also relates to an apparatus for carrying out the process.

BACKGROUND OF THE INVENTION

Following production and/or filling, packs are frequently provided with labels, material strips or the like which are applied to the outside of the pack, for example by adhesive bonding. It is necessary for the strip applied to be in the correct position. This is important, in particular, in the case of cigarette packs which are provided with a revenue-stamp or closure strip. It is not desirable for the latter to be in a is skewed position.

The object of the invention is to propose measures for monitoring packs, in particular cigarette packs, for the correct positioning of labels, material strips or the like.

SUMMARY OF THE INVENTION

In order to achieve this object, the process according to the invention is characterized by the following features:

a) the articles or (cigarette) packs are moved past sensors, b) at least one border edge of the blank or of the material strip is detected by the sensors by means of a checking beam, which emitted by one of the sensors and reflected back to same for its reception, c) at least two sensors scan spaced-apart checking locations or checking points of the border edge, d) the position signals picked up by the sensors are evaluated by an evaluation unit for a possible offset of the checking points in relation to one another.

Such a checking process is conducted during the continuous transport of the packs, namely in that the packs are moved past a checking apparatus with a transmitter and receiver for a checking beam, in particular for a laser beam.

The process according to the invention employs two basic methods of measurement: first, a distance measurement is conducted with the help of the checking beam. Here the invention takes into account the fact that the label or material strip mounted on a pack surface lies at a smaller distance from the checking element that the rest of the pack surface. The contour of the surface is accordingly scanned. The edge of the label or material strip forms a graduation in the contour.

An alternative method according to the invention involves the use of optic sensors which react to contrasts in the brightness and/or color of the background. This method assumes that the label or material strip to be scanned exhibits a different brightness value than the neighboring pack surface in order that the edge of the label or material strip can be accordingly scanned.

According to the process according to the invention at least two sensors or two spaced-apart scanning positions are provided, namely checking points at the edge of the label or material strip to be scanned. The sensors are positioned relative to each other so that they can detect, for example, a temporal or spatial mismatch when scanning the checking points of a crooked or misaligned label and cause an error signal to be derived by a central evaluation device.

Further features of the invention concern how the checking process is carried out and also the arrangement and configuration of the checking elements.

BRIEF DESCRIPTION OF THE DRAWINGS

An exemplary embodiment of an apparatus for producing and/or checking cigarette packs is explained in more detail in the following with reference to the drawings, in which is shown.

DESCRIPTION OF THE PREFERRED EMBODIMENTS

Figure 2:
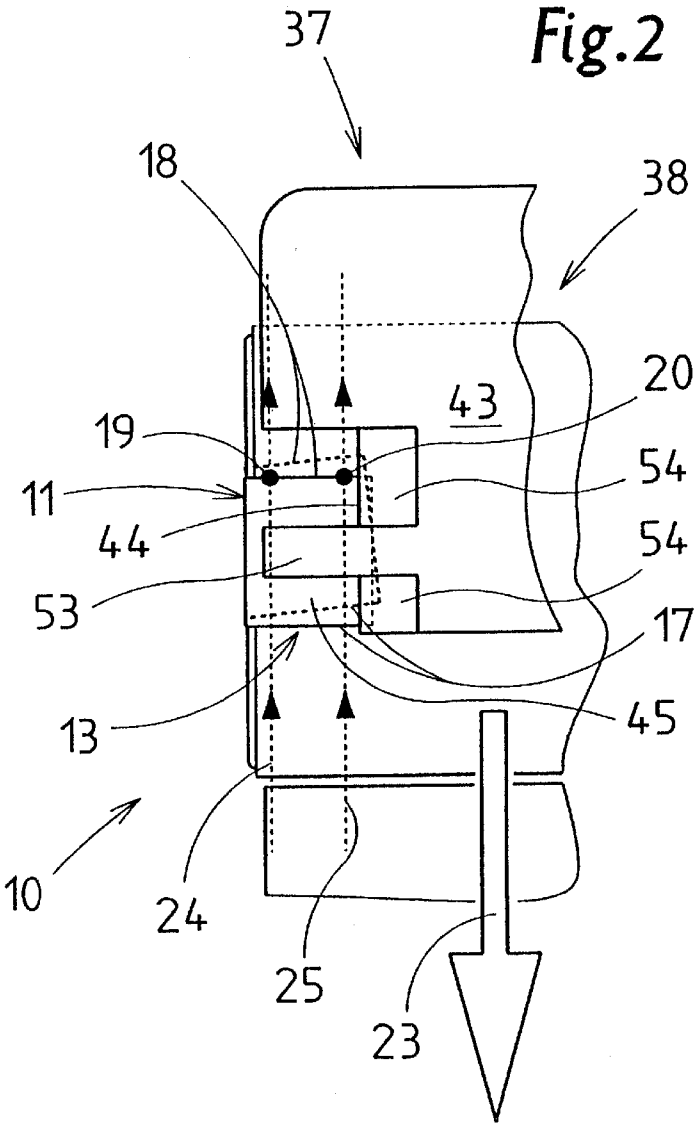
FIG. 2 a plan view of an end-side region of the cigarette pack during the checking operation, FIG. 3 a simplified illustration of part of a packaging machine, FIG. 4 on an enlarged scale, a detail of the circumference of a drying turret of the packaging machine according to FIG. 3, FIG. 5 a detail of the turret in an axial section, namely along section plane V—V from FIG. 4, FIG. 6. a plan view of a checking region of the turret corresponding to plane VI—VI, and FIGS. 7 to 10 graphic illustrations of a checking process.

The exemplary embodiments illustrated in the drawings deal with the checking of cigarette packs 10 with respect to the correct positioning of a material strip 11. The cigarette.pack 10 is a soft-carton pack of cuboidal format. The material strip 11 extends in the region of an end wall 12, to be precise in the center thereof, with legs 13, 14 in the region of a front wall 15 and of an opposite rear wall 16.

Figure 1:
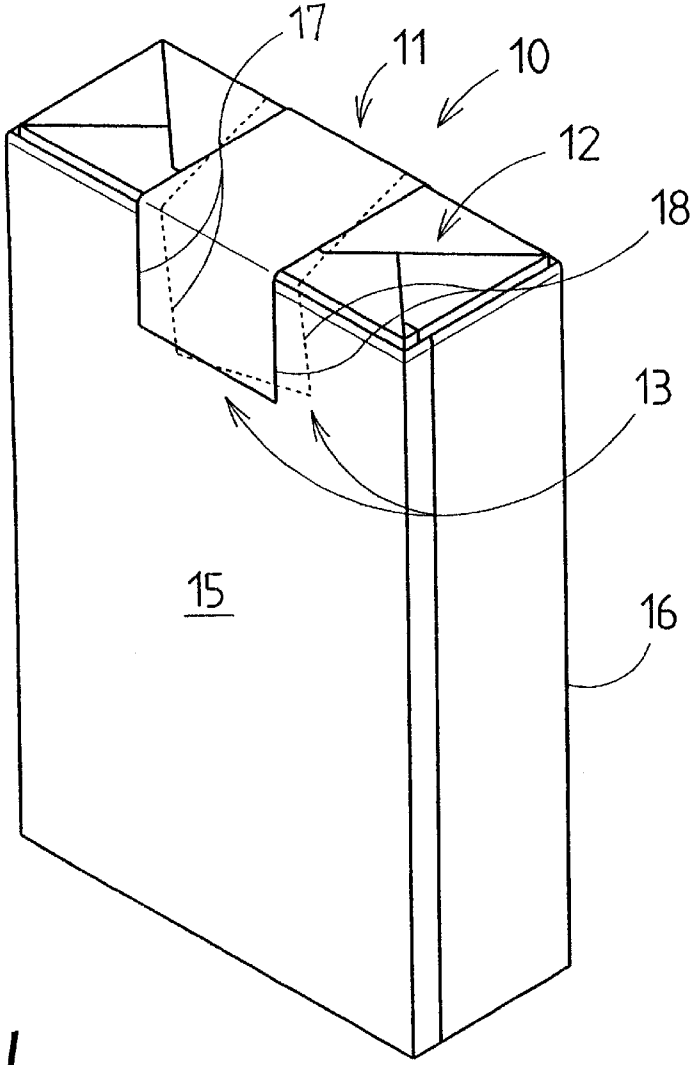
FIG. 1 a cigarette pack in a perspective view.
Figure 3:
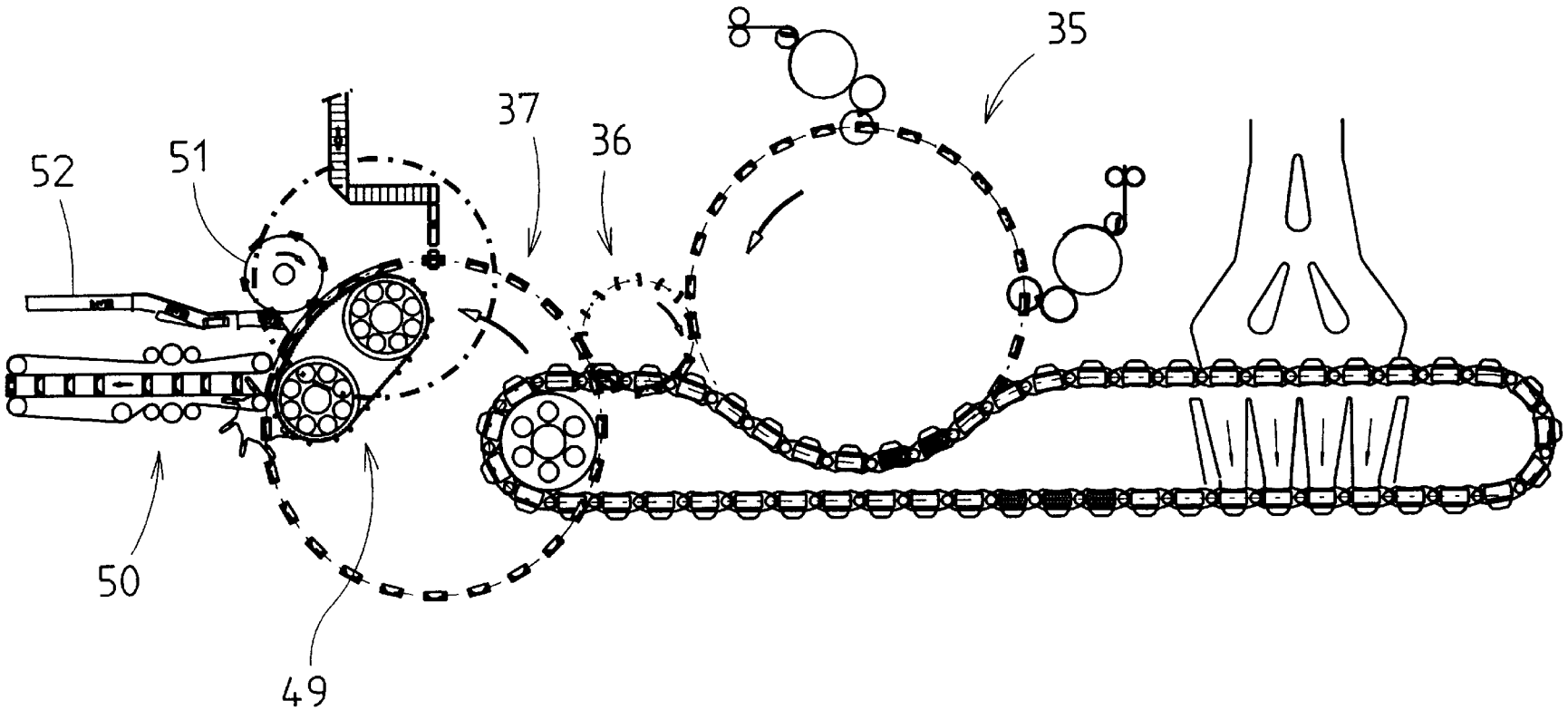
Figure 4:
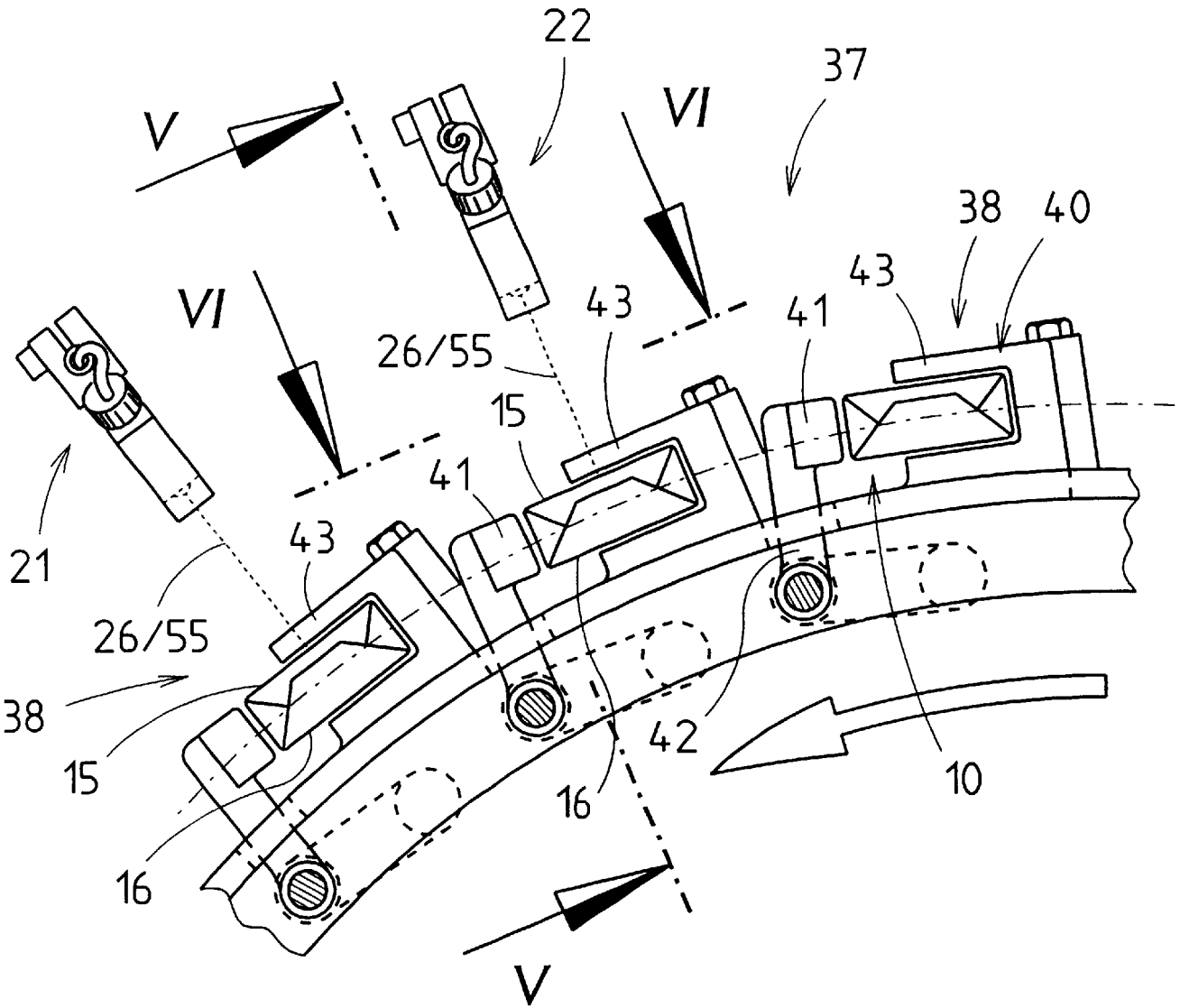
Figure 5:
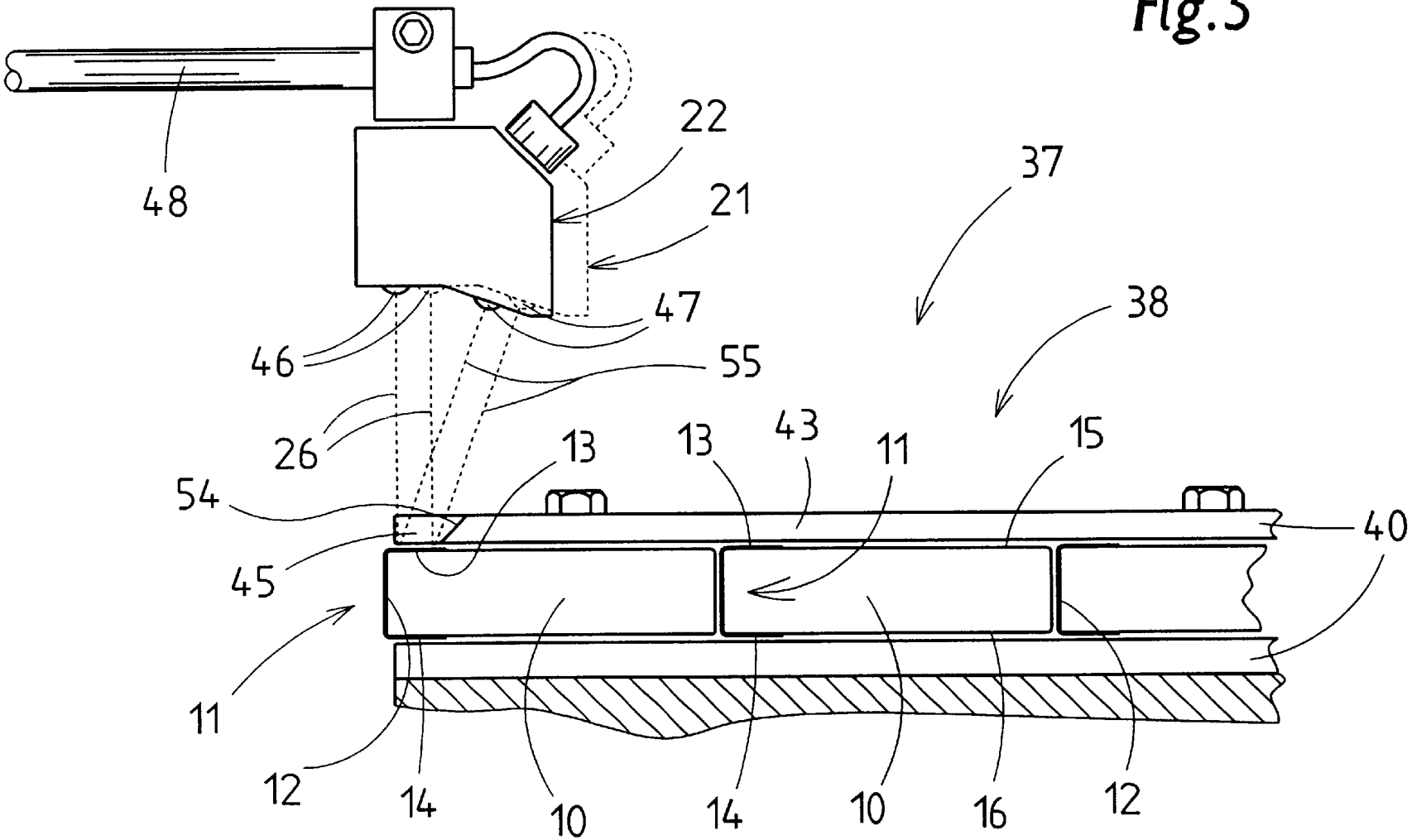
Figure 6:
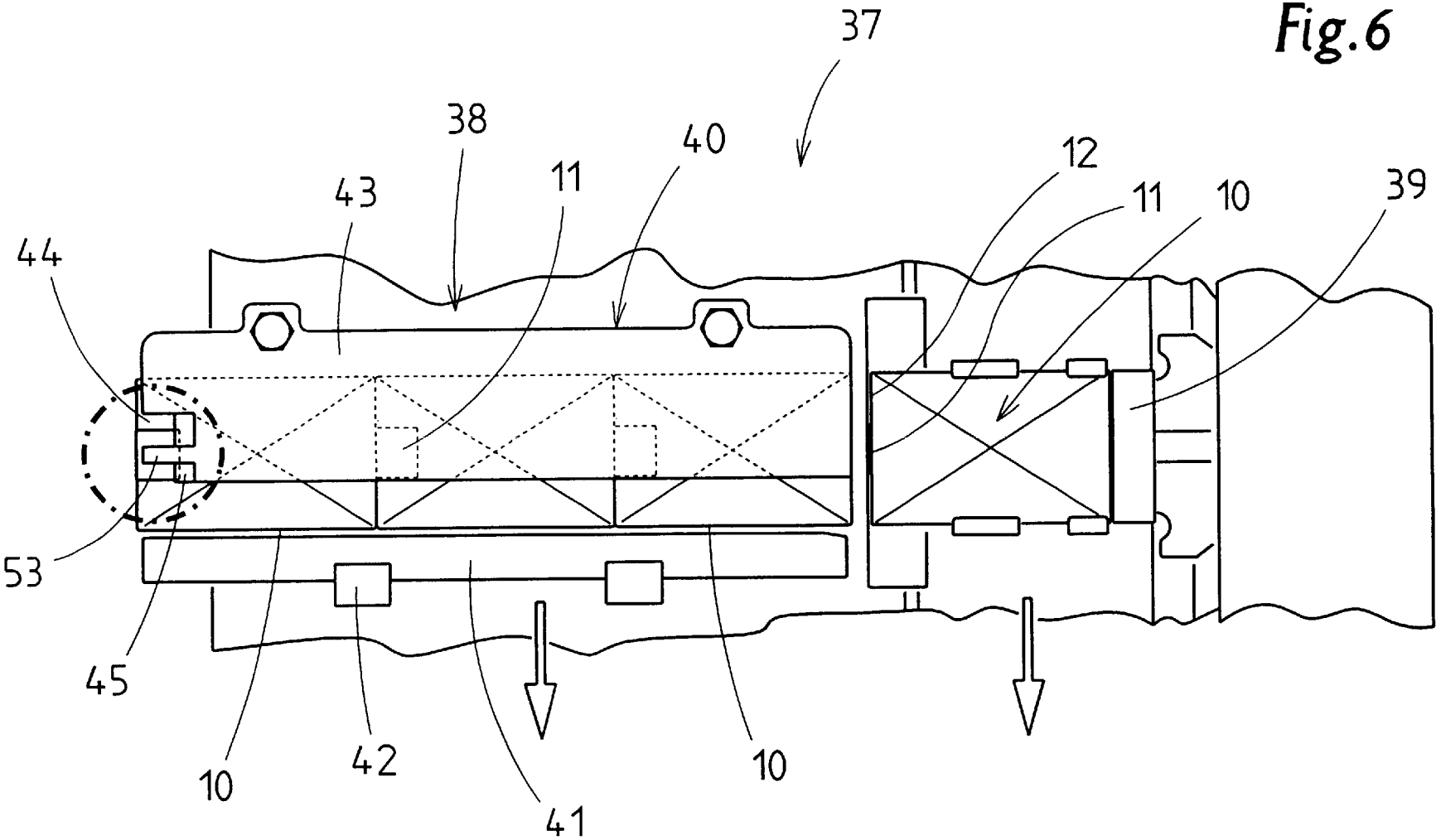

Once the cigarette pack 10 has been finished, the material strip 11 is mounted on it and affixed by adhesive bonding. The material strip 11 may occasionally be in a skewed position, as indicated by the dashed lines in FIG. 1, FIG. 2 and FIG. 12. Such cigarette packs 10 with an incorrectly positioned material strip 11 are intended to be detected and separated out.

In order to check the position of the material strip 11, the latter is sensed in the region of the leg 13 according to FIG. 1 to FIG. 6. The checking or measuring process used in this case is designed such that at least one border edge 17, 18 of the material strip 11 or of the leg 13, that is to say a boundary running transversely to the movement direction of the cigarette pack 10, is scanned and the relative position of the material strip 11 is reconstructed therefrom.

For this purpose, two spaced-apart checking regions or checking points 19, 20 at the material strip 11, namely at the border edges 17, 18, are localized. With the correct positioning of the material strip 11, the two checking points 19, 20 have to be located in a specific relative position to one another, namely on a line exactly transverse to the end wall 12. If the checking points 19, 20 are offset in relation to one another, the material strip 11 lies in an incorrect position.

The relative position of the checking points 19, 20 is determined in a contactless manner by sensors 21, 22. These are positioned at a distance from the movement path of the cigarette packs 10. The cigarette packs 10 are conveyed in the transverse direction, that is to say such that the border edges 17, 18 of the material strip 11 are directed transversely to the movement direction (arrow 23).

The relative position of the sensors 21, 22 is such that, during the movement of the cigarette packs 10, one sensor 21 senses along a first checking line 24 and the other sensor 22 senses the material strip 11 along a second checking line 25, at a distance from the first. The two checking lines 24, 25 run parallel to one another in the region of the material strip 11, namely of the leg 13.

The sensors 21, 22 scan the three-dimensional configuration of the material strip 11. For this purpose, the distance of a checking plane from the respective sensor 21, 22 is measured. In the region of the material strip 11, a different, smaller distance is given than outside the material strip 11 in the region of the front wall 15 of the pack. For this purpose, optical analog sensors which preferably operate with laser diodes are advantageously suitable. A checking beam 26 is directed onto the facing side of the cigarette pack 10 and reflected. The distance is measured precisely in accordance with a suitable measuring process, in particular in accordance with what is known as the triangulation process.

Figure 7:
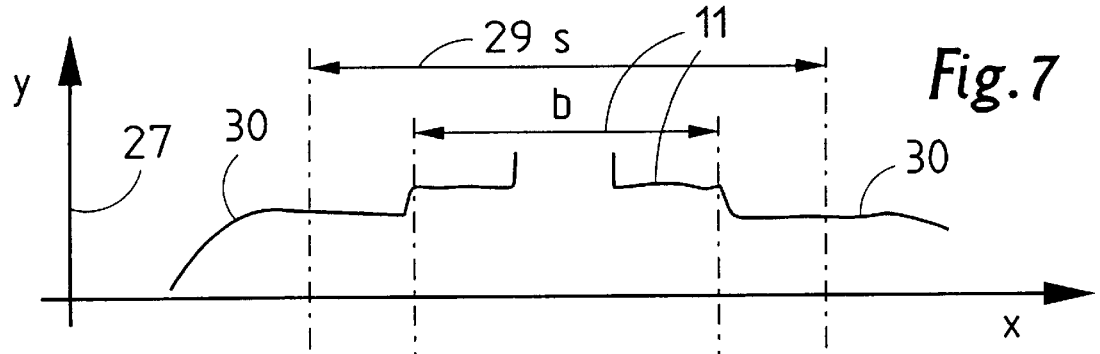
Figure 9:
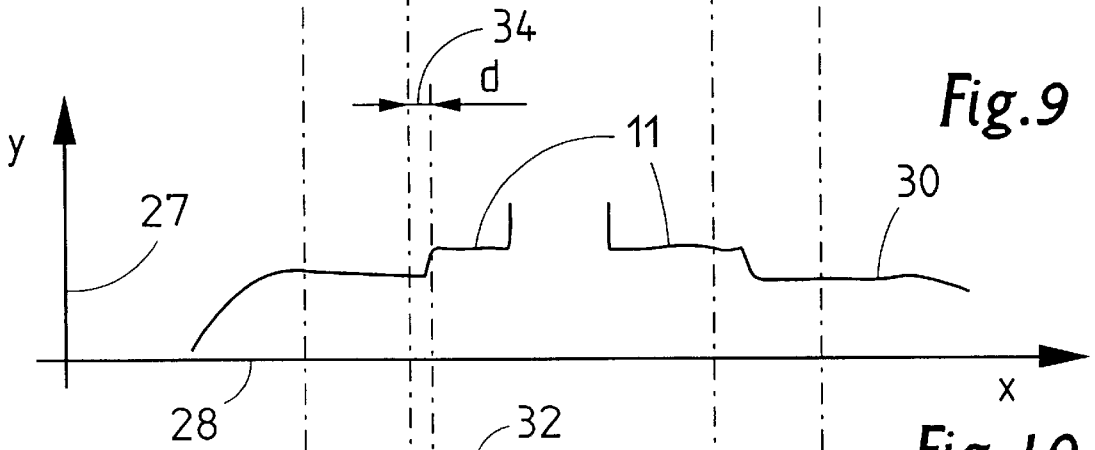

FIG. 7 and FIG. 9 show a profile of the scanned region of the cigarette pack 10. The distance, that is to say the profile, along the checking line 24, 25 is plotted on the y-axis 27. The x-axis 28 represents the checking path. The actual checking section 29 corresponds to the path which is sensed by the sensors 21, 22 with correct distance measurement. This produces a distance curve 30 with the profile of the material strip 11. A gap is produced centrally in the region of the distance curve 30 since, in this region, a web 53 is sensed as part of the outer wall 43. The corresponding distance signals are blanked out.

Figure 8:
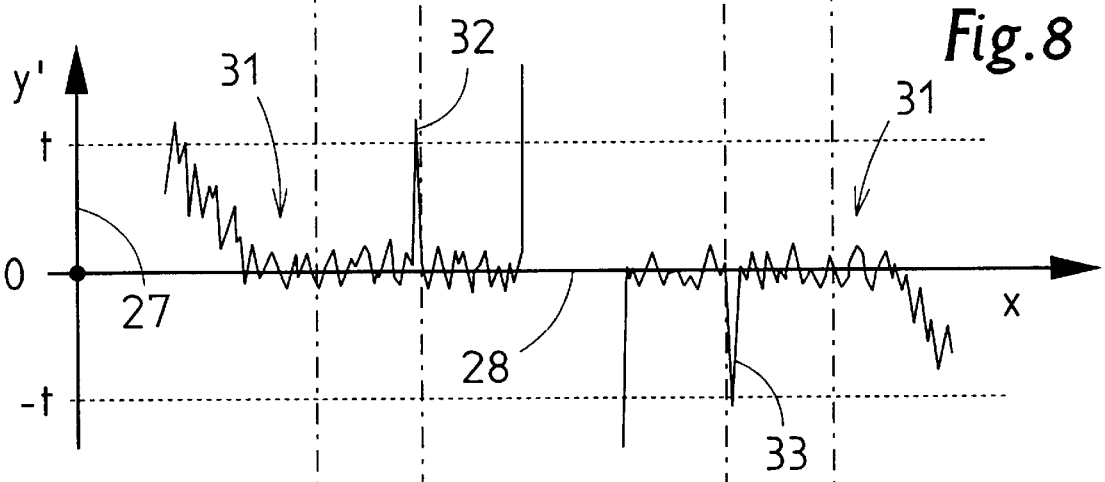
Figure 10:
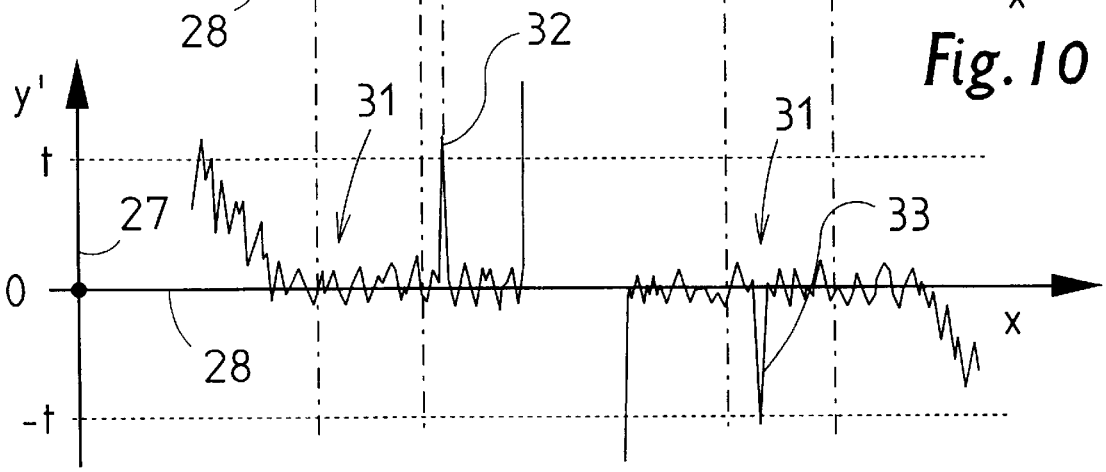

The evaluation—in an evaluation unit (not shown)—is based on the first derivation of the distance curve 30. This first derivation determines a slope curve 31 (FIGS. 8 and 10). A plurality of peaks are produced on account of the roughness of the surface. The border edges 17, 18 form a corresponding edge peak 32, 33. These two edge peaks 32, 33 have to extend in a predetermined spatial region if the material strip 11 is positioned precisely (FIG. 8). FIGS. 9 and 10 show an incorrect position of the material strip 11 with the border edges 17, 18 in a position which is offset by a distance 34 and with a corresponding offset of the edge peaks 32, 33. In the case of the measurement and/or checking of a material strip 11 which is in a slanted position corresponding to the dashed lines, the measurement along the first checking line 24 will give the image according to FIGS. 7 and 8. Sensing along the checking line 25 gives the result established in FIGS. 9 and 10. The comparison of the edge peaks 32, 33 in FIG. 8, on the one hand, and FIG. 10, on the other hand, results in the detection of the incorrect position of the material strip 11.

The measuring operation described is best carried out once the material strip 11 (or some other blank) has been affixed in some way. The packaging machine may be designed in accordance with U.S. Pat. No. 5,544,467. The more or less finished cigarette packs 10 are transferred from a folding turret 35, via an intermediate turret 36, to a drying turret 37. This too may be designed in accordance with U.S. Pat. No. 5,544,467. The drying turret 37 comprises a plurality of axis-parallel, elongate pockets 38 arranged along the circumference. These are of shaft-like design with an inner cross section which corresponds approximately to the outer cross section of the cigarette packs 10. The latter are pushed through the pockets in stepwise manner in an axis-parallel direction, the action of a cigarette pack 10 being pushed into a pocket 38 by a pusher 39 (FIG. 6) causing a material strip 11 which is held ready in a transverse plane to be folded around the end wall 12 in a U-shaped manner. The action of the cigarette pack 10 being pushed into the pocket 38 causes a cigarette pack 10 to be pushed out of the same pocket 38 on the opposite side (on the left in FIG. 6).

The pocket 38 encloses the (three) cigarette packs 10 by way of a C-shaped pocket profile 40. This exposes a lateral region of the cigarette packs 10. A movable side bar 41 forms a side wall of the pocket 38. The side bar 41 is connected to a pivotable lever 42. During the pushing movement of the cigarette packs 10 in the pocket 38, the side bar 41 is moved back slightly, with the result that the cigarette packs 10 can be moved freely.

The above described operation of checking the cigarette packs 10 for the positioning of the material strip 11 takes place in the region of the pockets 38, to be precise on the border-side cigarette pack 10 which is ready for being pushed out of the pocket 38. The pocket 38 or an outer wall 43 of the same is provided with end-side cutouts 44 and 45 in the operating region of the sensors 21, 22 . The pack 10 which is to be checked is positioned such that the material strip 11 or the leg 13 thereof is located with the border edges 17, 18 in the region of the cutouts 44, 45. The two border edges 17, 18 are sensed one after the other by the sensors 21, 22. A web 53 formed between the cutouts 44, 45 holds the cigarette pack 10 and/or the material strip 11 in the pack-specific position.

The axis-perpendicular boundaries of the cutouts 44, 45 are bounded by beveled surfaces, namely by bevels 54. These are directed such that it is possible to form a reflection beam 55 of the sensor 21 for the inner checking line 25 without it being adversely affected by the outer wall 43. This makes it possible for the checking line 25 to be positioned in the vicinity of the free transverse border of the material strip 11 and nevertheless for the material strip 11 or the leg 13 to be covered in a border region over the full width by the outer wall 43.

The sensors 21, 22 each have transmitters 46 and receivers 47. A laser diode or some other checking-beam source is arranged within a housing. The sensors 21, 22 are connected to an evaluation unit (not shown) via lines 48. For reasons of space, the sensors 21, 22 are offset in relation to one another in the circumferential direction of the drying turret 37 and in the radial direction of the same. The evaluation takes place with the cooperation of a resolver (not shown) which is assigned to the packaging machine and detects the precise angular position of all the subassemblies of the machine. The signals produced by the sensors 21, 22 are thus converted into angular positions. In this case, an incorrect position of, for example, 1° to 3° may be assumed as being a still acceptable skewed position of the material strip 11. The checking operation thus allows a tolerance range for the position of the material strip.

Defective packs which are detected are separated out. The cigarette packs 10 passing out of the drying turret 37 are transferred to a belt conveyor 49. This transports the cigarette packs 10 to a removal conveyor 50. Defective packs are separated out by a preliminary conveyor 51 and are transferred to a defective-pack conveyor 52. In this respect, the arrangement preferably corresponds to that of U.S. Pat. No. 5,784,855.

Figure 11:
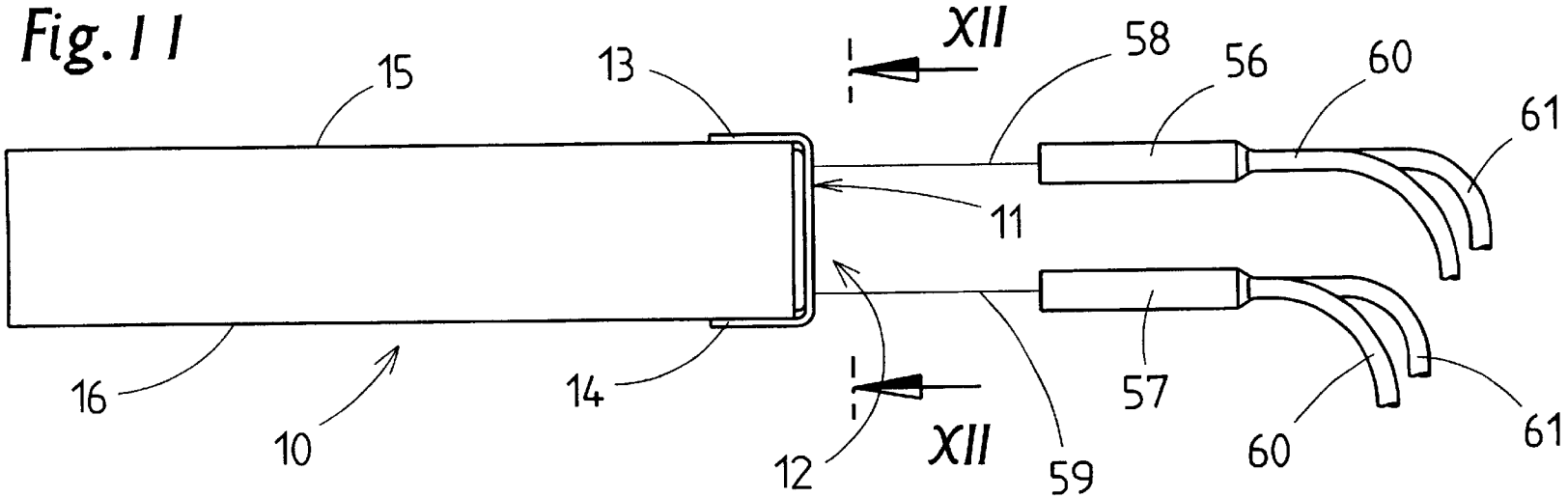
FIG. 11 side view of a cigarette pack to show another checking process.
Figure 12:
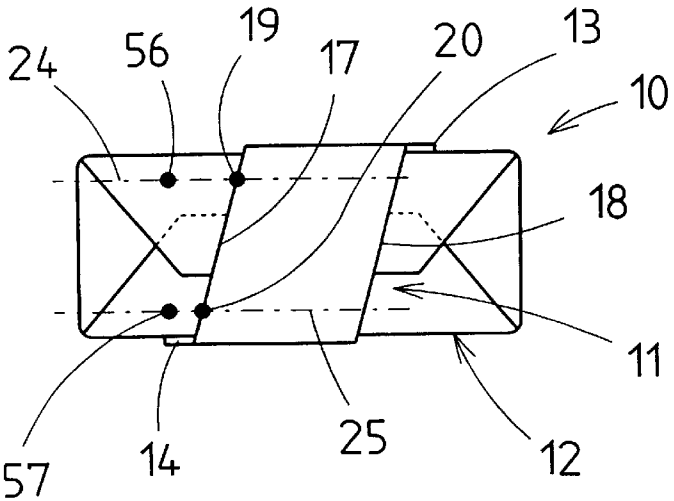
FIG. 12 end view of the cigarette pack according to FIG. 11.

According to the exemplary embodiment illustrated in FIG. 11 and FIG. 12, the positioning check for the material strip 11 is carried out in the region of end wall 12 of the cigarette pack. A checking element with (for example) two sensors 56, 57 arranged either next to or above one another assumes a stationary lateral position next to a path of movement for the cigarette packs 10. In this case, the checking process, as in the exemplary embodiment described above, can be carried out in the region of a drying turret 37. However, the checking process can also be made in the region of another pack conveyor, for example a straight-line one, in that the end walls 12 are directed laterally.

The checking unit, namely the sensors 56, 57, operate according to another checking principle. The sensors 56, 57 are contrast-or color-sensitive. That means that a checking beam 58, 59 directed onto the end wall 12 or onto the material strip 11 is immediately reflected and picked up again by the same sensor 56, 57. Sensors 56, 57 are connected via wires 60, 61, in particular glass fiber cables, to a preferably remote recording unit 62. This unit reacts to differences in contrast or color of the reflected checking beams 58, 59. Due to differences in contrast, the border edges 17 of the material strip 11 to be scanned, or checked, are detected since these usually have a different brightness value than the neighboring pack surface.

As in the exemplary embodiment described above, the two sensors 56, 57 or the checking beams 58, 59 form a checking line through the movement of the packs or of the end wall 12. On the path of the same the checking points 19, 20 are detected due to the change in contrast.

In the case of a correctly positioned material strip 11 the two sensors 56, 57 will detect a change in brightness or contrast at the same time. A material strip 11 which is askew or otherwise incorrectly positioned will result in a temporal and thus a spatial offset of the checking points 19, 20. This causes a signal to be sent by the recording unit 62 via a control line 63 to the evaluation unit.

Figure 13:
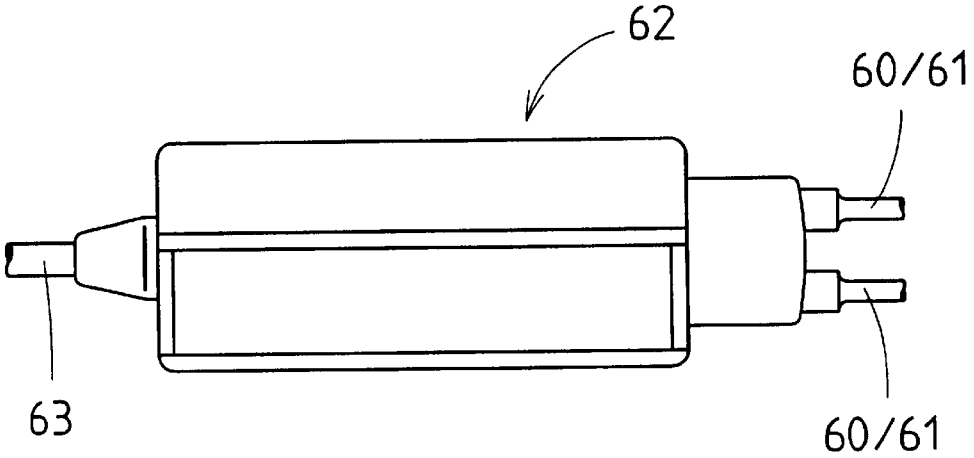
FIG. 13 part of a checking element in the exemplary embodiment shown in FIG. 11.

The described checking apparatuses, in particular those according to FIG. 11 to FIG. 13, can also be employed in identifying material strips 11 which may be properly aligned exactly transverse to the end wall but which lie offset with respect to the center of the end wall 12. By virtue of the monitoring of the movement flows of all elements of a packaging machine, it is possible to define precisely the time when the border edge 17 or 18 must pass the two sensors 56, 57 or the checking beams 58, 59. The occurrence of a time delay in one direction or the other results from an incorrect positioning of the material strip.

LIST OF DESIGNATIONS

10 Cigarette pack
11 Material strip
12 End wall
13 Leg
14 Leg
15 Front wall
16 Rear wall
17 Border edge
18 Border edge
19 Checking point
20 Checking point
21 Sensor
22 Sensor
23 Arrow
24 Checking line
25 Checking line
26 Checking beam
27 y-axis
28 x-axis
29 Checking section
30 Distance curve
31 Slope curve
32 Edge peak
33 Edge peak
34 Distance
35 Folding turret
36 Intermediate turret
37 Drying turret
38 Pocket
39 Pusher
40 Pocket profile
41 Side Bar
42 Lever
43 Outer wall
44 Cutout
45 Cutout
46 Transmitter
47 Receiver
48 Line
49 Belt conveyor
50 Removal conveyor
51 Preliminary conveyor
52 Defective-pack conveyor
53 Web
54 Bevel
55 Reflection beam
56 Sensor
57 Sensor
58 Checking beam
59 Checking beam
60 Wire
61 Wire
62 Recording unit
63 Control line

What is claimed is:

1. A method for detecting the positioning of a label attached to a surface of a pack and presenting a raised contour thereon, the method comprising the steps of:

moving a plurality of said packs along a conveying path with an edge of said label disposed transverse to a conveying direction;

detecting, using at least two sensors, reflections from at least two locations on each said moving pack, wherein each said reflection is indicative of a distance between one of said sensors and one of said locations, wherein each said location is either on said label or on said surface, and wherein said locations are spaced apart transverse to the conveying direction and define scanning paths extending along each said moving pack and intersecting spaced-apart points on said edge of said label;

converting said reflections into electrical signals varying in accordance with the surface contour of said pack along said paths;

forming first derivatives of said electrical signals, wherein said first derivatives exhibit peaks representative of the relative locations in the conveying direction of said spaced-apart points on said edge;

using an offset in the conveying direction between said location of said points to evaluate the orientation of said edge of said label; and separating said pack from the conveying path if the orientation of said edge is different from a predetermined orientation.

2. A method according to claim 1, wherein said predetermined orientation is perpendicular to the conveying direction.

3. A method according to claim 1, wherein said detecting step is performed using a reflection of a laser beam directed toward said pack.

4. An apparatus for detecting the positioning of a label attached to a surface of a pack and presenting a raised contour thereon, the apparatus comprising:

a conveyor for moving a plurality of said packs along a conveying path with an edge of said label disposed transverse to a conveying direction;

a plurality of sensors for detecting reflections from at least two locations on each said moving pack, wherein each said reflection is indicative of a distance between one of said sensors and one of said locations, wherein each said location is either on said label or on said surface, and wherein said locations are spaced apart transverse to the conveying direction and define scanning paths extending along each said moving pack and intersecting spaced-apart points on said edge of said label;

electrical circuitry for converting said reflections into electrical signals varying in accordance with the surface contour of said pack along said paths;

an evaluation unit for forming first derivatives of said electrical signals, wherein said first derivatives exhibit peaks representative of the relative locations in the conveying direction of said spaced-apart points on said edge, said evaluation unit determining from an offset in the conveying direction of the location of said two points the orientation of said edge of said label; and a removal device for separating said pack from the conveying path if the orientation of said edge is different from a predetermined orientation.

5. An apparatus according to claim 4, wherein:

each of said sensors directs a laser beam toward each of said packs and receives a reflection of said laser beam from said pack; and said conveyor includes pockets for holding said packs, said pockets having cutouts permitting said laser beam to impact said pack.

6. An apparatus according to claim 5, wherein two said cutouts are formed in the region of an outer wall of each of said pockets so that said edge of said label is detected in the region of said cutouts, and a web is formed between said cutouts.

7. An apparatus according to claim 4, wherein:

said sensors are spaced apart in the conveying direction; and said sensors are spaced apart transverse to the conveying direction a distance corresponding to the distance between said locations.

8. An apparatus according to claim 4, wherein said removal device removes said pack from a side of said conveyor at which said sensors are disposed.

9. An apparatus according to claim 4, wherein said edge of said label is disposed at an end wall of said pack and said sensors direct horizontal laser beams toward said pack.

* * * * *